US007066683B2

(12) United States Patent
Way

(10) Patent No.: US 7,066,683 B2
(45) Date of Patent: Jun. 27, 2006

(54) HYDRAULICALLY OPERATED LOW PROFILE BOAT LIFT UTILIZING AT LEAST TWO PILINGS

(76) Inventor: Robert L. Way, 4505 8th St., Court E., Ellenton, FL (US) 34222

( * ) Notice: Subject to any disclaimer, the term of this patent is extended or adjusted under 35 U.S.C. 154(b) by 0 days.

(21) Appl. No.: 10/659,516

(22) Filed: Sep. 11, 2003

(65) Prior Publication Data

US 2005/0058508 A1 Mar. 17, 2005

(51) Int. Cl.

| | |
|---|---|
| ***B63C 3/06*** | (2006.01) |
| ***B63C 3/12*** | (2006.01) |
| ***B66F 7/04*** | (2006.01) |
| ***B66D 1/36*** | (2006.01) |

(52) U.S. Cl. ..... 405/3; 254/89 H; 254/336; 254/338

(58) Field of Classification Search ..... 405/3, 405/1, 221; 114/44; 254/89 H, 336, 338
See application file for complete search history.

(56) References Cited

U.S. PATENT DOCUMENTS

| | | | | | |
|---|---|---|---|---|---|
| 3,073,125 | A | * | 1/1963 | Pearlson | 405/3 |
| 3,978,676 | A | | 9/1976 | Chambers | |
| 4,329,082 | A | * | 5/1982 | Gillis | 405/3 |
| 4,432,664 | A | | 2/1984 | Baldyga | |
| 4,509,446 | A | * | 4/1985 | Sutton | 114/45 |
| RE32,118 | E | | 4/1986 | Godbersen | |
| 4,641,596 | A | * | 2/1987 | Reprogle et al. | 114/44 |
| 4,641,996 | A | * | 2/1987 | Seal | 405/2 |
| 4,678,366 | A | * | 7/1987 | Williamson | 405/3 |
| 4,686,920 | A | * | 8/1987 | Thomas | 405/3 |
| 4,850,741 | A | | 7/1989 | Timmerman | |
| 4,895,479 | A | | 1/1990 | Michaelsen et al. | |
| 4,973,094 | A | * | 11/1990 | Tana et al. | 294/81.21 |
| 5,051,027 | A | * | 9/1991 | Horton | 405/3 |
| 5,090,841 | A | * | 2/1992 | Penick et al. | 405/3 |
| 5,099,778 | A | * | 3/1992 | Palen | 114/45 |
| 5,245,940 | A | * | 9/1993 | Rockwood | 114/48 |
| 5,275,505 | A | | 1/1994 | Wilcox | |
| 5,314,263 | A | * | 5/1994 | Stokoe et al. | 405/1 |
| 5,378,082 | A | * | 1/1995 | Hiller et al. | 405/3 |
| 5,427,471 | A | * | 6/1995 | Godbersen | 405/3 |
| 5,522,671 | A | * | 6/1996 | Keesling | 405/3 |
| 5,655,850 | A | * | 8/1997 | Holmgren | 405/3 |
| 5,772,360 | A | * | 6/1998 | Wood, II | 405/3 |
| 5,915,877 | A | * | 6/1999 | Sargent et al. | 405/3 |
| 5,988,941 | A | * | 11/1999 | Sargent et al. | 405/3 |
| 6,174,106 | B1 | * | 1/2001 | Bishop et al. | 405/3 |
| 6,230,639 | B1 | * | 5/2001 | McLaughlin et al. | 114/44 |
| 6,470,816 | B1 | * | 10/2002 | Golden et al. | 114/44 |
| 6,484,655 | B1 | * | 11/2002 | Gibson | 114/44 |
| 6,494,155 | B1 | * | 12/2002 | Gibson | 114/44 |
| 6,554,533 | B1 | * | 4/2003 | Godbersen | 405/3 |
| 6,640,736 | B1 | * | 11/2003 | McLaughlin et al. | 114/44 |

(Continued)

*Primary Examiner*—Suzanne Dino Barratt
*Assistant Examiner*—Gay Ann Spahn
(74) *Attorney, Agent, or Firm*—Arthur G. Yeager

(57) ABSTRACT

An assembly for lifting a boat locatable adjacent a dock requires only two elongate vertically disposed pilings each having a lower end portion mounted into the floor of a body of water near the dock and an upper end portion extending upwardly adjacent the dock. A lift is connected to a boat cradle for moving the cradle substantially vertically and includes a piston/cylinder attached between the dock and cables, which are mounted to each piling and are connected between the piston and the cradle. The piston is movable between a first position for lifting and pulleys and guides are mounted to the pilings and the cradle.

16 Claims, 9 Drawing Sheets

U.S. PATENT DOCUMENTS 6,695,533 B1 * 2/2004 Bulmann ..... 405/3
6,709,197 B1 * 3/2004 Sargent et al. ..... 405/3
2001/0006590 A1 * 7/2001 Bishop et al. ..... 405/3
2002/0083876 A1 * 7/2002 Gibson ..... 114/45
2002/0150427 A1 10/2002 Godbersen
2005/0013663 A1 * 1/2005 Basta ..... 405/3
2005/0047867 A1 * 3/2005 Edson ..... 405/3
2005/0087116 A1 * 4/2005 Golden et al. ..... 114/44

* cited by examiner

HYDRAULICALLY OPERATED LOW PROFILE BOAT LIFT UTILIZING AT LEAST TWO PILINGS

CROSS REFERENCE TO RELATED APPLICATIONS

Not Applicable.

Statement Regarding Federally Sponsored Research or Development

Not Applicable.

Reference to a Microfiche Appendix

Not Applicable.

BACKGROUND OF THE INVENTION

1. Field of the Invention

This invention relates to a boat lift and, more particularly, to a hydraulically operated boat lift including a plurality of pulleys for raising and lowering a boat along two pilings.

2. Related Art

A multiplicity of boat lifts have been employed by prior art for docking vessels or lifting them out of the water for servicing. One type of such boatlifts is hydraulically operated by a plurality of pulleys and cables. However, conventional hydraulic boat lifts employing such pulleys and cables typically require unsightly overhead steel construction and are free standing, i.e. not secured to a dock, as illustrated in FIG. 1 of published U.S. Patent Application No. 2002/0150427 and U.S. Pat. No. Re. 32,118 both to Godbersen, for example.

As a result, such boat lifts must be supported by four pilings and require a large amount of space for allowing a boat to maneuver therebetween. In addition, such boatlifts typically position their mechanical/electrical components at heights well-above an operator's reach thereby making access to such components difficult.

In view of the foregoing background, it is therefore an object of the present invention to provide a hydraulically operated boat lift supportable by only two pilings with readily accessible components.

BRIEF SUMMARY OF THE INVENTION

In one aspect of the present invention there is provided an assembly for lifting a boat locatable adjacent a dock comprising a pair of elongate vertically disposed pilings having a lower end portion mounted into the floor of a body of water near such dock and an upper end portion extending upwardly adjacent such dock, a cradle for carrying a boat and lifting means connected to the cradle for moving the cradle substantially vertically. The lifting means includes a movable member attached to such dock, and cable means mounted to each piling and being connected between the movable member and the cradle, the movable member being movable between a first position for lifting the cradle and a second position for lowering the cradle. The movable member includes a hydraulic operating means having an extensible piston and a stationary cylinder, the cable means mounted to the piston. The lifting means includes at least one pulley on each piling for mounting the cable means to each piling. The assembly also includes a pair of guide members mounted between the cradle and slidably engaged with each piling for inhibiting lateral movement of the cradle when the cradle is being moved vertically. Each guide member includes rollers mounted against the respective piling. The cradle further includes a pair of bunk rails each having one end secured to a respective one of a pair of guide members and each having one free end disposed substantially perpendicularly to the respective guide members, the cradle further including a pair of elongate bunks secured onto and extending transversely across the pair of bunk rails for maintaining a water vessel therebetween. The assembly also includes a second pair of pilings oppositely spaced from the first pair of pilings and mounted adjacent the free ends of the pair of bunk rails and onto a floor of a body of water; and a second pair of guide members secured to respective free ends of the pair of bunk rails and movable along the second pair of pilings for providing stability to the cradle as said cradle moves along the pair of pilings. The pilings are inclined from the vertical direction with the lower end portion of each piling being located outwardly of a dock and the upper end portion of each piling being closely adjacent to the dock.

In another aspect of the present invention there is provided an assembly for lifting a boat locatable adjacent a dock comprising a pair of elongate vertically disposed pilings having a lower end portion mounted into the floor of a body of water spaced away from such dock and an upper end portion extending upwardly spaced away from such dock, a cradle for carrying a boat located between the dock and the pilings, hydraulic lifting means having a stationary member and an extensible member connected to the cradle for moving the cradle substantially vertically, and cable means mounted to such dock and the pilings and connected between the extensible member and the cradle, the movable member being movable between a first position for lifting the cradle and a second position for lowering the cradle. The lifting means further includes at least one pulley mounted on the dock for mounting the cable means to the dock. There is also included a pair of guide members mounted between the cradle and each piling for inhibiting lateral movement of the cradle when the cradle is being moved vertically. Each guide member is rigidly mounted to the cradle and slidably engaged with a respective piling. Each guide member includes rollers mounted against the respective said piling. The pilings are inclined from the vertical direction with the lower end portion of each piling being located outwardly of a dock and the upper portion of each piling being close to the adjacent dock. The cradle further includes a pair of bunk rails each having one end secured to a respective one of the pair of guide members and each having one free end disposed substantially perpendicularly to the respective guide members, the cradle further including a pair of elongate bunks secured onto and extending transversely across the pair of bunk rails for maintaining a water vessel therebetween.

An additional aspect of the present invention provides a boat lift mounted to a dock comprising a cable-handling system including: a pair of elongate pilings each having one end mounted into a floor of a body of water and an opposite end extending above an edge of a dock, a movable piston arm and an oppositely disposed stationary cylinder end secured to a dock, a first plurality of pulleys attached between the piston and the cylinder, a second plurality of pulleys cooperating with the first plurality of pulleys and disposed outside of the cable-handling unit, respectively; a cradle for supporting a boat thereon and being operatively movable in a substantially vertical direction along the pair of pilings; a pair of elongate cables each having one end routed through the piston arm and affixed to the cradle and an opposite end secured to the dock and routed through the first and second pluralities of pulleys, the first plurality of pulleys directing the cables in a substantially horizontal direction and the second plurality of pulleys guiding the cables vertically adjacent the pair of pilings, the piston being extensible to a first position away from the cylinder end for lowering the cradle vertically adjacent the pair of pilings and being retractable to a second position for raising the cradle vertically adjacent the pair of pilings. The cradle includes a pair of guide members for slidably moving the cradle along the pair of pilings. One end of each pair of cables is secured to a respective one of the pair of guide members for raising and lowering the cradle. The cradle further includes a pair of bunk rails each having one end secured to a one of a pair of guide members and each having one free end disposed substantially perpendicularly to the respective guide members, the cradle further including a pair of elongate bunks secured onto and extending transversely across the pair of bunk rails for maintaining a water vessel therebetween.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements throughout, and prime and double prime notations are used to indicate similar elements in alternate embodiments.

Figure 1:
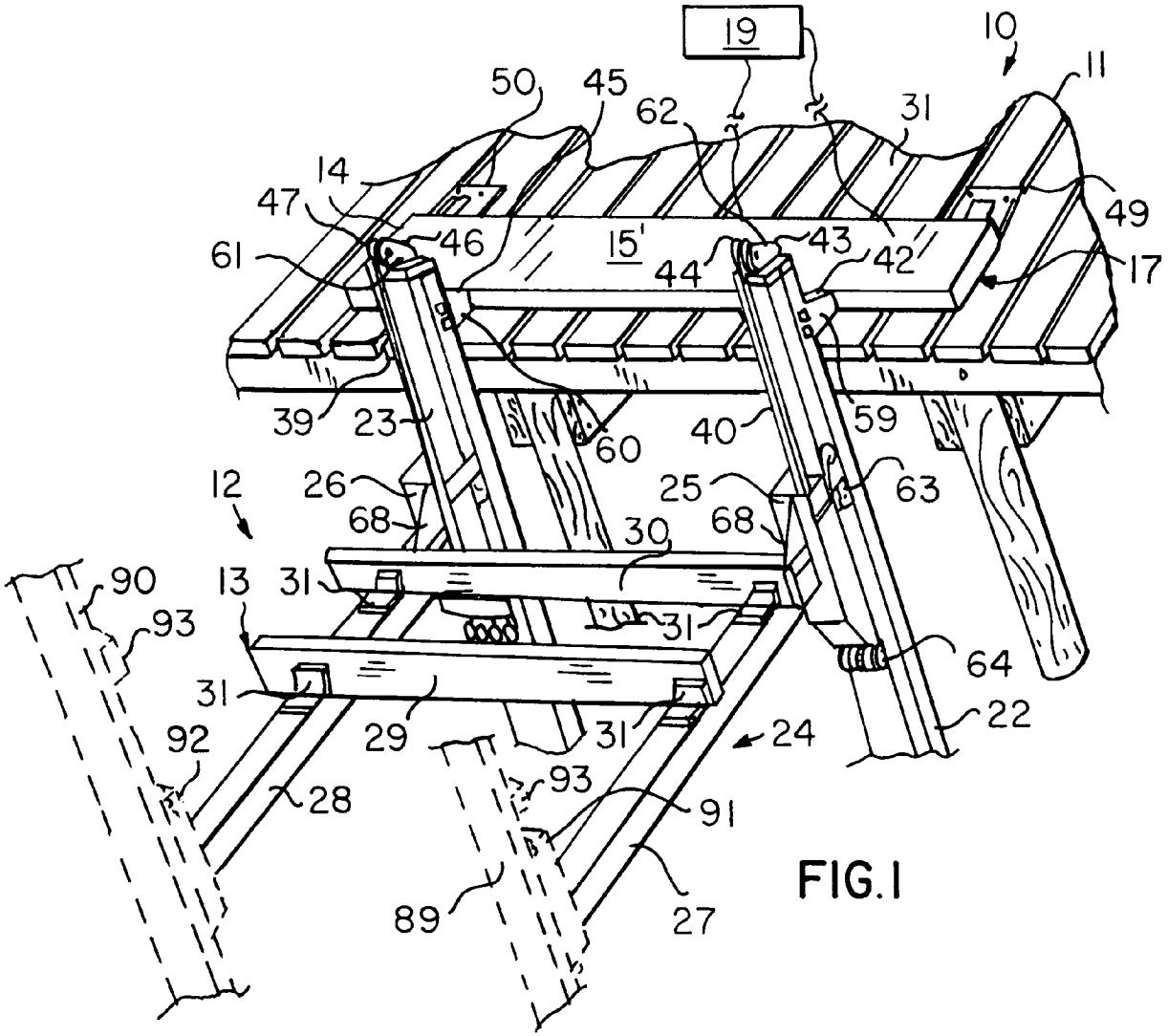
FIG. 1 is a perspective view of a boat lift attached to a dock, in accordance with the present invention.

The present invention is a hydraulically operated boat lift having a plurality of embodiments: each shown generally at numeral 12 securable to the end of a dock 11, as generally shown at 10 in FIG. 1. The boat lift 12 is also securable to a bulkhead (not shown) or other similar structure that can sufficiently support the combined weight of a boat and boat lift 12.

In construction, the boat lift 13 includes a lift cradle, each embodiment of which is identified by numeral 13 and lift means 14 that further includes an elongate cable-handling unit (CHU), each embodiment of which is identified by numeral 15. The top cover 15' is generally rectangular and is removable and may serve as an access panel for accessing the interior of the CHU 15. Lift cradles 12 may employ various specific structures such as that shown by numeral 24 of FIG. 1.

Figure 7:
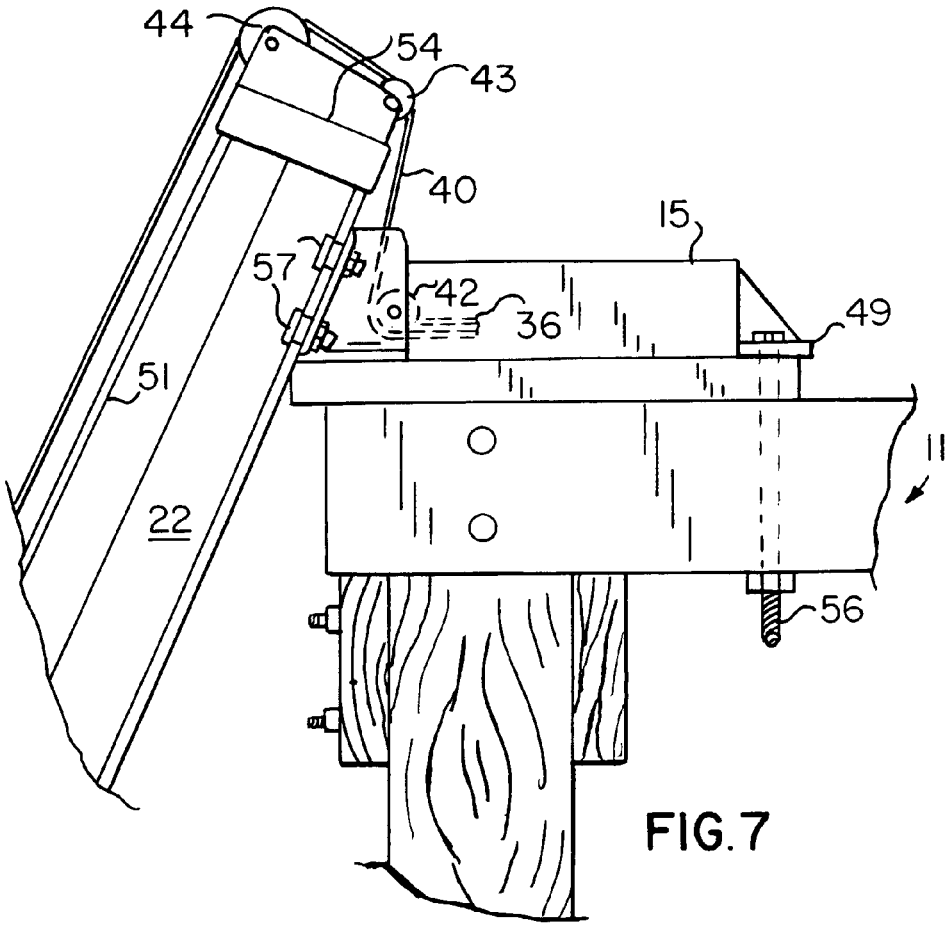
FIG. 7 is an enlarged side elevational view of the boat lift shown in FIG. 1.
Figure 8:
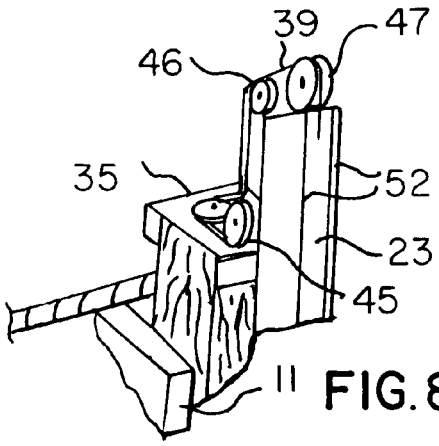
FIG. 8 is a partial perspective view showing the orientation of a plurality of pulleys for directing a cable up and over a boat lift piling, in accordance with the present invention.
Figure 9:
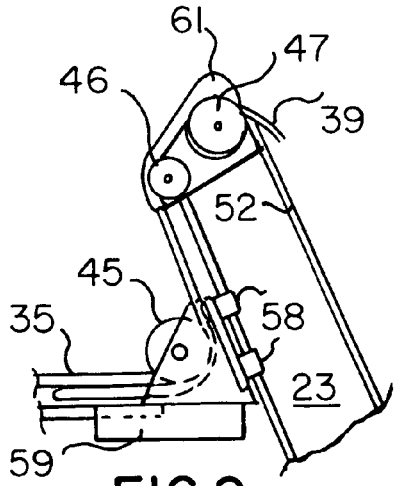
FIG. 9 is a partial side elevational view of the pulley arrangement shown in FIG. 8.

As perhaps best shown in FIG. 7, the bottom surface of the CHU 15 at each end thereof is secured to the top surface of the dock 11 via conventional brackets 49 and fasteners 56, as commonly known in the boating industry. The brackets 49, 50 may have a horseshoe shape as shown in FIG. 1, or may have an alternate shape, as shown in FIG. 7. In either case, the fastening member 56, such as a threaded screw, for example, is preferably passed through its corresponding bracket 49, 50 and the dock 11 for firmly securing the CHU 15 thereto.

Figure 2:
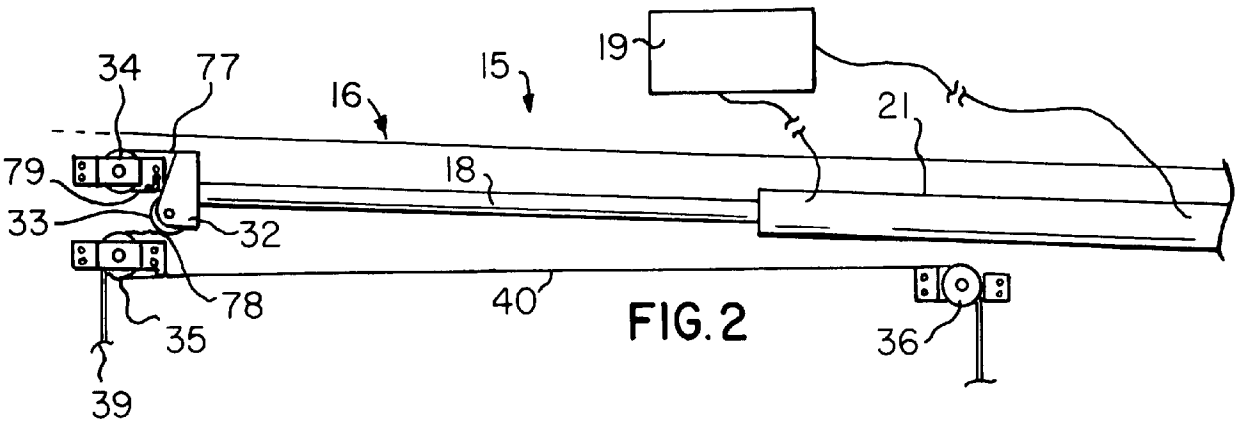
FIG. 2 is a partial top plan view of a cable-handling unit shown in FIG. 1 and with its top cover removed.
Figure 6:
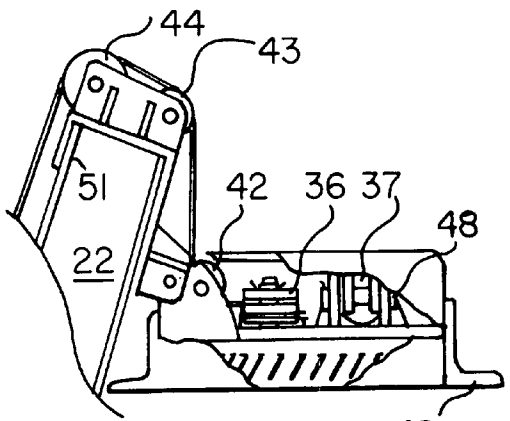
FIG. 6 is a partial side view showing a partial cross section of the cable-handling unit shown in FIG. 5.

Now referring to FIG. 2, a conventional hydraulic system 16 including piston arm 18 and cylinder 20 (FIG. 12), is housed within and at one end of the CHU 15. Of course, the piston arm 18 may be positioned at the opposite end of the CHU 15 if desired. A conventional sump or fluid reservoir 19 (FIG. 15) is removably attached to the piston arm 18 and positionable on or beneath the dock 11, as desired by an operator. The fluid reservoir 19 may include a pair of hoses for supplying and withdrawing fluid to and from the cylinder 20, respectively. One hose is connected adjacent to the stationary cylinder end 21 and the other hose is connected closer to the movable end 32 of piston arm 18 thereof.

With the stationary cylinder end 21 of the piston arm 18 being secured at one end of the CHU 15 via conventional means via bracket 48, the movable end 32 of the piston arm 18 is allowed to expand and contract within the CHU 15 and along the longitudinal length thereof as the fluid reservoir 19 operates the piston arm 18 in a manner well known in the industry. As clearly shown, the top cover 15' of the CHU 15 may be removed to provide ready access to the mechanical parts housed therein.

The CHU 15 further houses a portion of pulley/cable system 17 (FIG. 1) which, in the embodiment shown has a first plurality of pulleys 33–36 with pulley 36 positioned at one end of the CHU 15 adjacent the stationary end 21 of the piston arm 18, and pulleys 34–35 positioned at the opposite end of the CHU 15. Pulley 33 is fixed to the movable end 32 of the piston arm 18 and travels back and forth along the length of the CHU 15 and in a substantially horizontal direction corresponding to travel path of the movable end 32 of the piston arm 18. Such a movable end 32 can slide between a fully retracted position and a fully extended position where the fully retracted position places the movable end 32 of the piston arm 18 adjacent to the stationary end 21 thereof for maintaining the boat at a high position and the fully extended position places the movable end 32 of the piston arm 18 adjacent to pulleys 34, 35 for maintaining the boat at a low position.

Pulleys 34, 35 are spaced substantially equidistant from movable pulley 33 when the movable end 32 of the piston arm 18 is at a fully extended position and are preferably aligned with the piling 23 while pulley 36 is preferably aligned with piling 22. Pulleys 34, 35, 36 are secured to the bottom surface of the CHU 15 via conventional brackets and screws and therefore are stationary with respect to the movable pulley 33. A pair of cables 39, 40 each have one end connected to the movable end 32 of the piston arm 18 and are guided through the pulleys 33–36, as dearly shown in FIG. 2. With the predetermined orientation of such pulleys, a moderate to heavy boat may be vertically lifted/lowered a distance, 3*D, by horizontally transferring the moving end 32 of the piston arm 18, D, as discussed in more detail hereinbelow.

Figure 3:
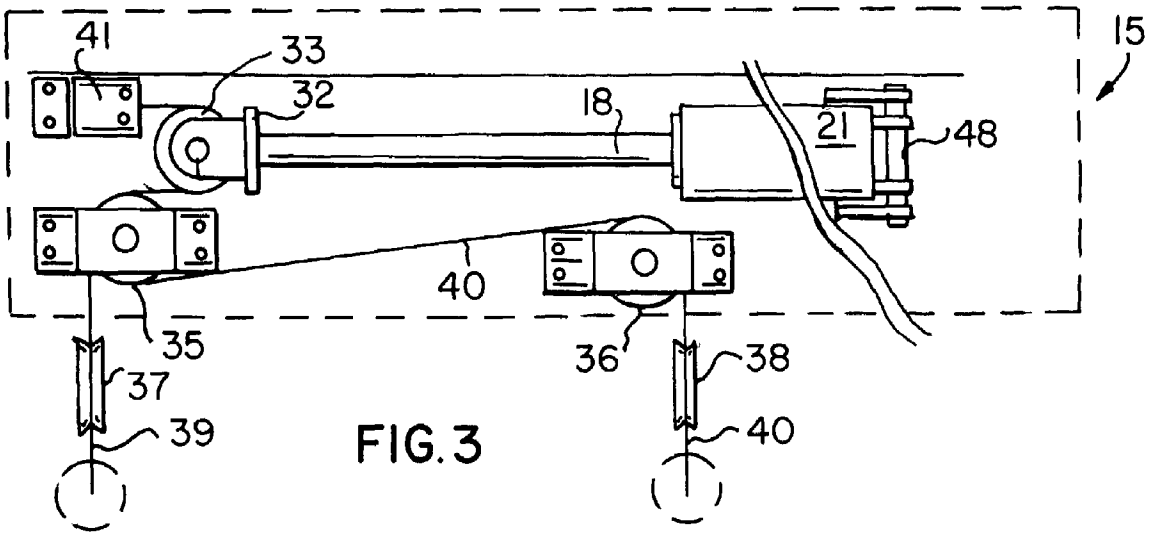
FIG. 3 is a partial top plan view showing an alternate embodiment of the cable-handling unit of FIG. 2.

In an alternate embodiment of the CHU 15, as shown in FIG. 3, pulley 34 is removed from the CHU 15 and is replaced with a support member 41. Such a support member secures one end of each cable 39, 40 as same are guided through the pulleys 33, 35, 36, 37, 38 in a manner dearly shown.

Figure 4:
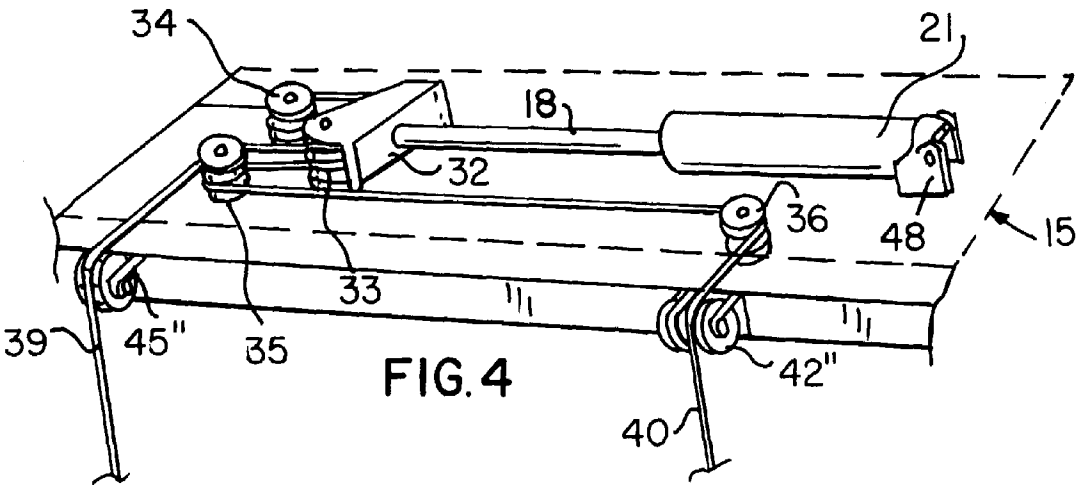
FIG. 4 is a perspective view showing an alternate embodiment of the cable-handling unit of FIG. 2.

FIG. 4 shows yet an alternate embodiment of the present invention wherein the cables 39, 40 are not directed up and over a pair of corresponding pilings 23, 22, respectively, as discussed hereinbelow. Rather, such cables are guided downwardly via pulleys 42", 45" where they connect to corresponding transfer members 26, 25 for lifting/lowering the cradle 13. Now referring to FIGS. 5–10, pilings 22, 23 are secured to the end of the dock 11 by conventional brackets with a second plurality of pulleys 42–44, 45–47 positioned adjacent and on top thereof, respectively via fasteners 57, 58. In particular, pulleys 42 receive cable 40 from pulley 36 for directing cable 40 up and over piling 22 via pulleys 43,44 for connecting to an associated transfer member 25. Accordingly, pulleys 36, 42 transition the path of cable 40 from a substantially horizontal direction from within the CHU 15 to a substantially vertical direction as cable 40 exits the CHU 15.

FIGS. 5–10 illustrate the embodiment wherein pilings 22 and 23 are slightly inclined to minimize the chance that boat 67 may bump up against the pilings 22 and 23 and associated pulley and cable apparatus when being moved vertically, particularly upwardly. With the exception of the slanted configuration the apparatus of FIG. 11 functions exactly as described hereinabove.

Pulleys 43, 44 are secured to a cap 54 at the top end of piling 22 for guiding the cable 40 downwardly and generally outwardly along the piling 22 and connect cable 40 to transfer member 25 movable along the length of piling 22. The opposite end of cable 40 is attached to a top end of transfer member 25 via a conventional locking device 65 readily known in the industry and as clearly shown in FIG. 10.

Cable 39 exits the CHU 15 in a generally horizontal direction and opposite to where cable 40 exits CHU 15. Pulleys 35, 45 guide cable 39 in a substantially vertical direction up piling 23 to the top end thereof where pulleys 46, 47 are secured to a cap 55 positioned at the top end of the piling 23. Such pulleys 46, 47 guide cable 39 downwardly and generally outwardly along the piling 23 and attach cable 39 to transfer member 26 movable along the length of piling 23.

Both transfer members 25, 26 help lift/lower the cradle 13 including a pair of bunk rails 27, 28 extending outwardly and perpendicularly therefrom. Thus, each elongate member 27, 28 has one end secured to a corresponding transfer member 25, 26 and supported in place by support members 68, shown in FIG. 10. The free end of each elongate member 27, 28 is positioned on the far side of the respective pilings 22, 23. Each support member 68 provides sufficient support to allow the cradle 13 to support a boat thereon. Transfer member 25 includes a pair of roller sets 63, 64 spaced at opposed ends thereof. It is noted that transfer member 26 is substantially similar to transfer member 25 and, therefore, it should be understood that both transfer members perform substantially the same function in substantially the same manner. Roller sets 63, 64 are secured to their corresponding transfer member 25 via conventional means wherein a corresponding plurality of top rollers 63 are secured to a top end of transfer member 25 via a bracket 66. Such a bracket 66 is attached around the top end of the transfer member 25 for maintaining roller set 63 in place as the transfer member 25 moves upwardly and downwardly along piling 22.

Piling 22 includes a ledge 51 protruding laterally from a far side thereof with the ledge 51 providing a travel path for roller set 63 at a nearside thereof as transfer member 25 moves up and down the length of the piling 22. Such a ledge 51 assists in supporting the weight of the cradle 13 and boat thereon by allowing the roller set 63 to firmly press thereagainst while a corresponding bottom roller set 64 firmly presses in an opposed direction against far side 69 of ledge 51. Accordingly, the opposing forces directed by the two sets of rollers 63, 64 on ledge 51 substantially cancel out each other and help stabilize the cradle 13 and boat thereon when being lifted/lowered by the boat lift 20. Piling 23 has a substantially similar ledge 52 for supporting the top and bottom sets of rollers as transfer member 26 moves up and down piling 23.

As shown in FIG. 1, a pair of elongate bunks 29, 30 transversely extend across the bunk rails 27, 28 and are connected to the top surfaces thereof via a pair of conventional brackets 31 as readily known in the industry. Each bunk 29, 30 is positioned on its side to be capable of supporting a maximum load thereon while sufficiently spaced apart to allow the boat to rest thereon and maintain the bottom 76 thereof above bunk rails 27, 28.

As shown in broken line in FIG. 1, a second pair of pilings 89, 90 may be positioned adjacent each respective free end of bunk rails 27, 28 in a manner for allowing a second pair of transfer members 91, 92 to attach to such free ends and move upwardly and downwardly along the pilings 89, 90 corresponding to the movement of transfer members 25, 26. The second pair of transfer members 91, 92 may not be connected to additional cables and pulleys. In such case, the transfer members 91, 92 would primarily function as guides to prevent lateral movement of the cradle 13 as it travels up and down the pilings 89, 90 during heavy winds and the like. A pair of stops 93 may be inserted at a predetermined position along the second pair of pilings to prevent the cradle 13 from moving therebeyond. Pulley brackets 59–62 are conventional as understood in the art.

Figure 11:
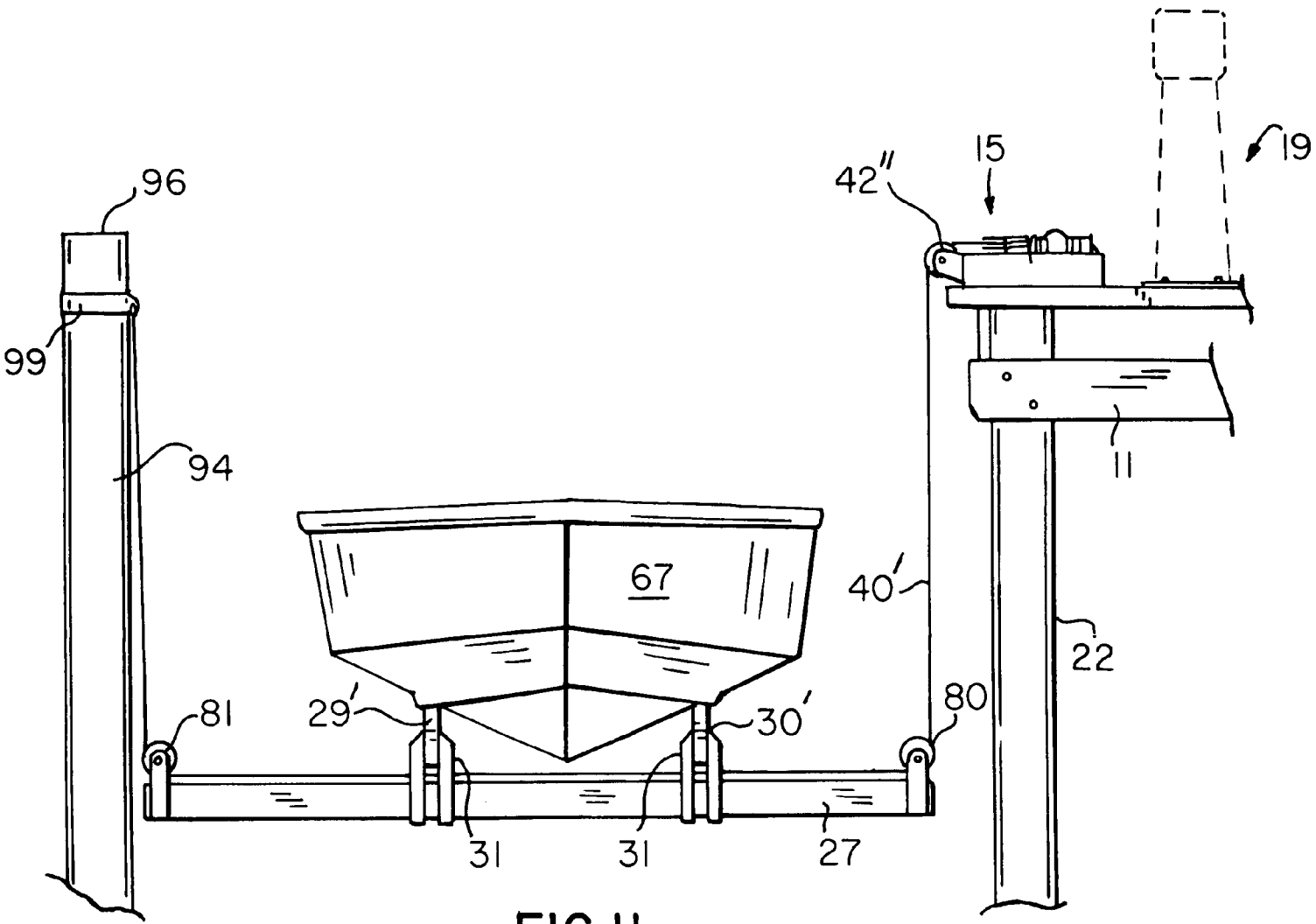
FIG. 11 is a side elevational view showing an alternate embodiment of the present invention.
Figure 12:
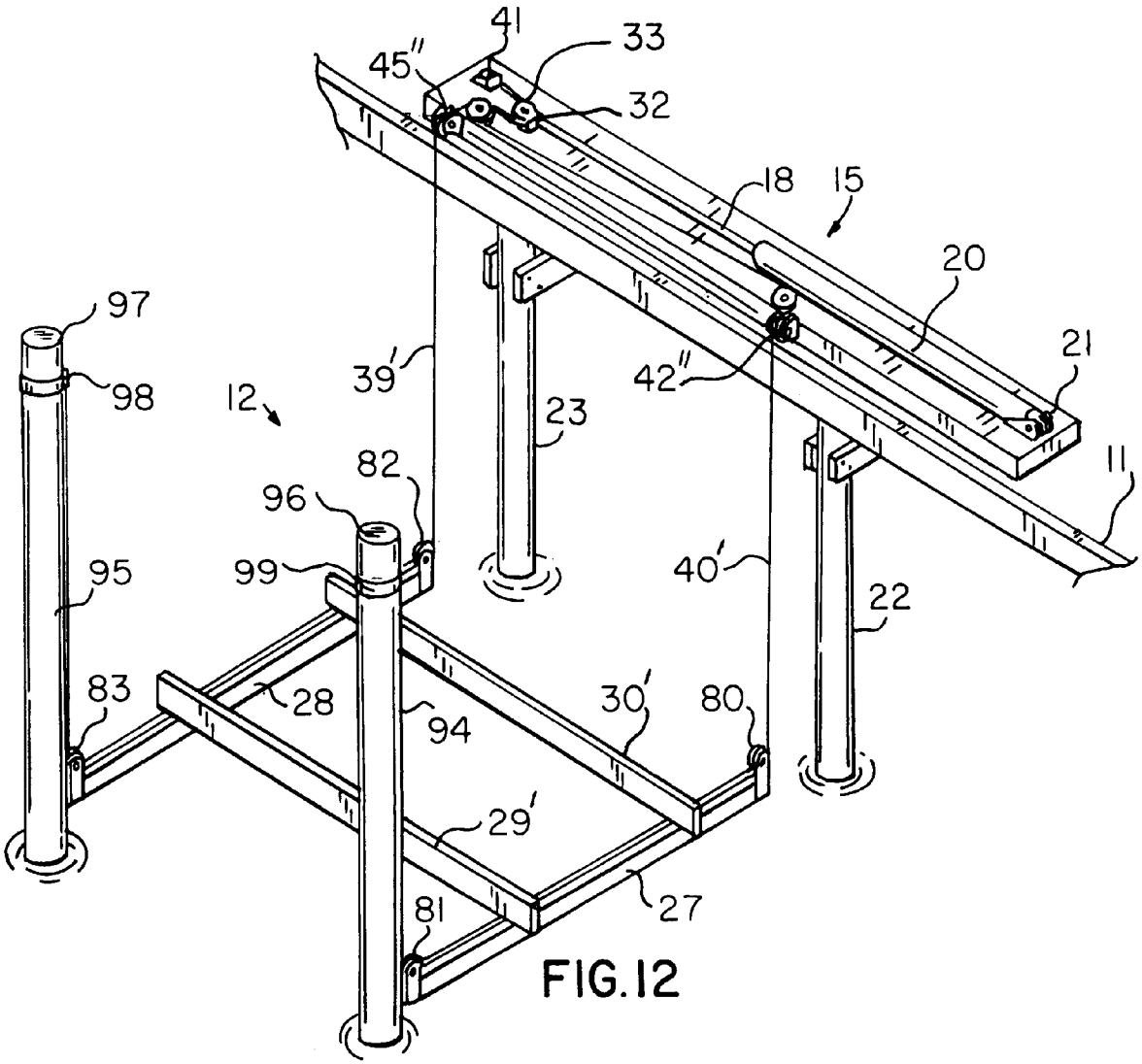
FIG. 12 is a perspective view of the embodiment of FIG. 11.

Now referring to FIGS. 11–12, an alternate embodiment of the boat lift 12 is shown wherein the pair of pilings 22, 23 are disposed away from the end of the dock 11 and supported by the bottom of a body of water. Each end of cables 40', 39' are secured to a top end 96, 97 of the pilings 22, 23 by a pair of brackets 98, 99, respectively. The pilings 22, 23 are spaced apart from each other and are aligned with corresponding pulleys 42", 80, 81 and 45··, 82, 83, respectively. Pulleys 80, 81 are attached at opposite ends of elongate bunk rail 27 and pulleys 82, 83 are attached at opposite ends of elongate bunk rail 28. A pair of bunks 29, 30 each have opposite ends secured to the bunk rails 27, 28 and are disposed generally medially thereof for receiving a boat thereon.

As each cable 39', 40' exits the cable-handling unit, pulleys 80, 81, 82, 83 guide the cables 40', 39' along the top of the bunk rails 27, 28 and towards pilings 22, 23, respectively. The cables 39', 40' then travel upwardly along the pilings 22, 23 and are secured to the tops thereof, respectively. Advantageously, the cradle 13 is supported at a near end by pulleys 80, 82, and at a far end by pulleys 81, 83 so that when the cables 40', 39' are retracted, lifting forces are distributed at such pulleys 80, 81 82, 83, or opposite ends of the cradle 13, for raising same in a substantially vertical manner.

The alternate embodiment of the boat lift 12, shown in FIGS. 11–12, is operated in a substantially similar manner as the previous embodiment. With the cable-handling unit 15 cylinder piston arm 18 in the fully retracted position, the bunks 29', 30' will be at their highest position relative to a dock 11 surface. This position, for ease of explanation will be referred to as the parked position. From the parked position, when the fluid reservoir on/off switch 101 is placed in the "on" position, a drive (raise) command is generated for commanding the movable end 32 of the piston arm 18 to retract fully thereby removing the load from the set parking latch (not shown). In particular, as the movable end 32 of the piston arm 18 retracts, the movable pulley 33 mounted thereto begins to pull against the cables 39', 40'. The pulley bracket 41 holds one end of the cables 39', 40' stationary, thereby translating all resultant force through the moving pulley 33 and pulleys 35', 42", 45" (FIG. 4) and finally against the brackets securing the cable ends to the top of the pilings 22, 23.

Accordingly, by shortening/lengthening of the cables 39', 40' between their two respective anchored ends causes the cradle 13, suspended therebetween, to be raised or lowered. Before such a cradle can be lowered, the parking latch (not shown) has to be de-selected, this may be done either manually, by moving a release lever (not shown), or electrically, by moving the brake release switch 100 from the park to the operate position. In the event of power failure, there are provisions within the fluid reservoir 19 to manually lower the cradle.

Figure 13:
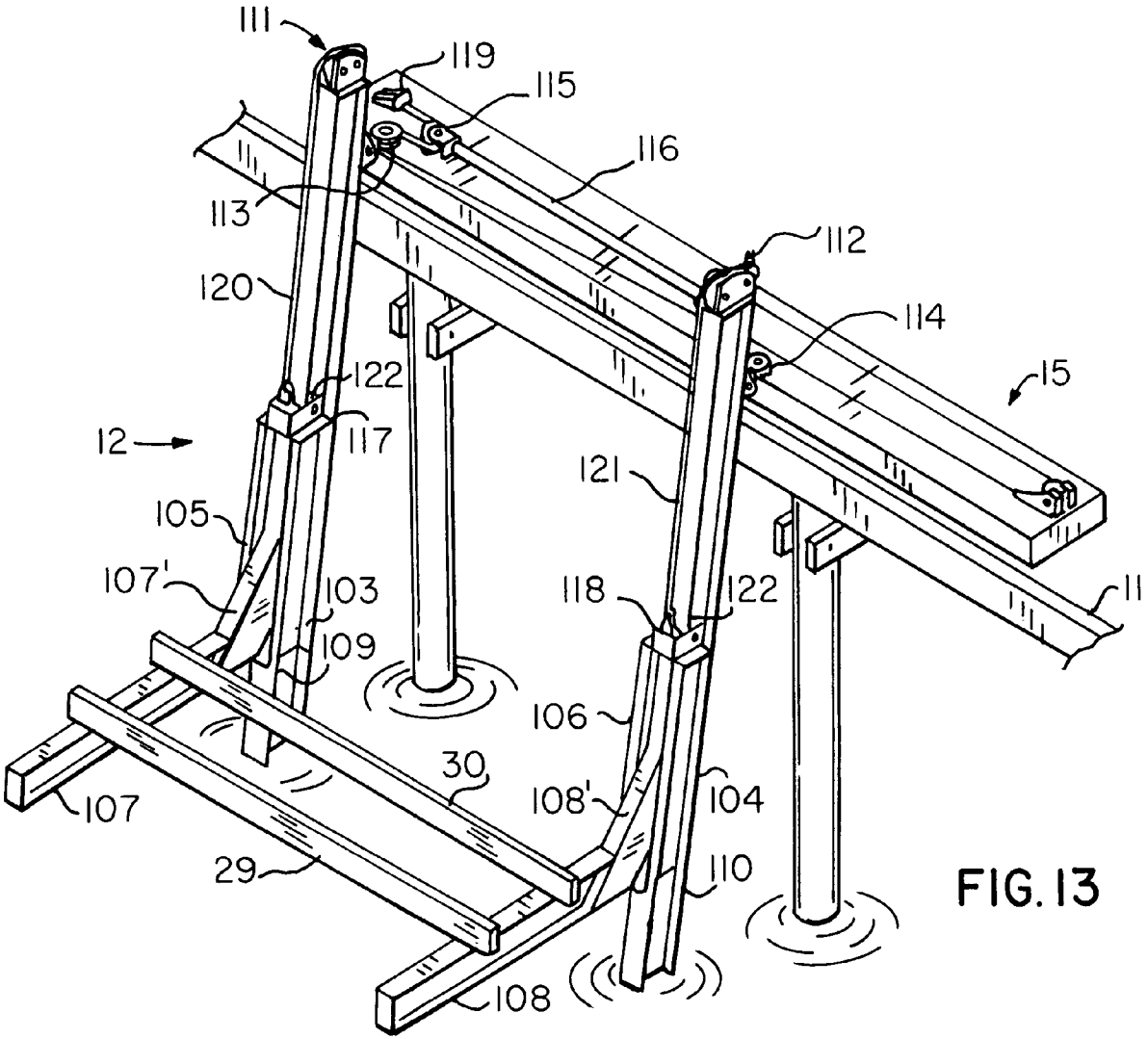
FIG. 13 is a perspective view of an alternate embodiment of the present invention.

With regard to FIG. 13, an alternate embodiment of the lift 12 is illustrated. A pair of tilted pilings 103 and 104 carry a respective pair of elevator trolleys 105 and 106. Bunk rails 107 and 108 carry bunks 29 and 30. 107' and 108' are support members formed either integrally with rails 107 and 108 respectively or are attached in a conventional manner as understood in the art. Lower trolley rollers 109 and 110 and upper trolley rollers 117 and 118 guide trolleys 105 and 106. Cable portions 120 and 121 are as before as are cable-handling unit 15, pulley assemblies 111–114; arm 116; end 115, brackets 122 and anchor 119.

The embodiment of FIG. 13 provides a function similar to the embodiment of FIGS. 5–10 by providing more clearance between a boat 67 and the pulley/cable apparatus near the upper portion of pilings 103 and 104.

Figure 14:
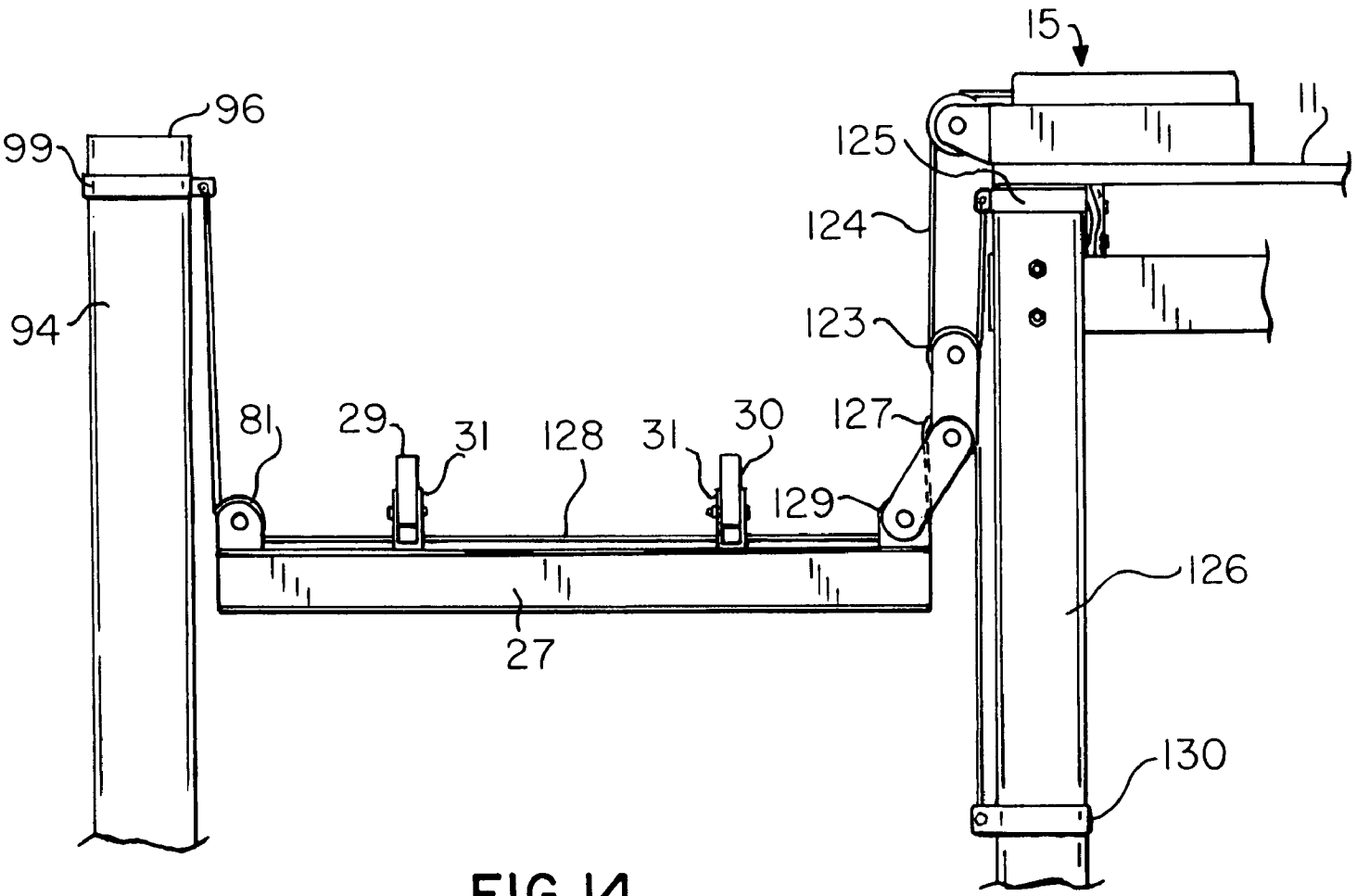
FIG. 14 is a perspective view of an alternative embodiment of the present invention.

FIG. 14 illustrates another embodiment of the lift 12 that provides an alternate to the approach of FIG. 11. An upper pulley 123 routes a lifting cable 124 to a fixed strap 125 mounted on piling 126. A lower pulley 127 routes a carrying/guide cable 128 that provides load equalizing between rails 27 and 28 and to upper strap 99 via a second lower pulley 129. The other end of cable 128 is anchored at strap 130.

Figure 15:
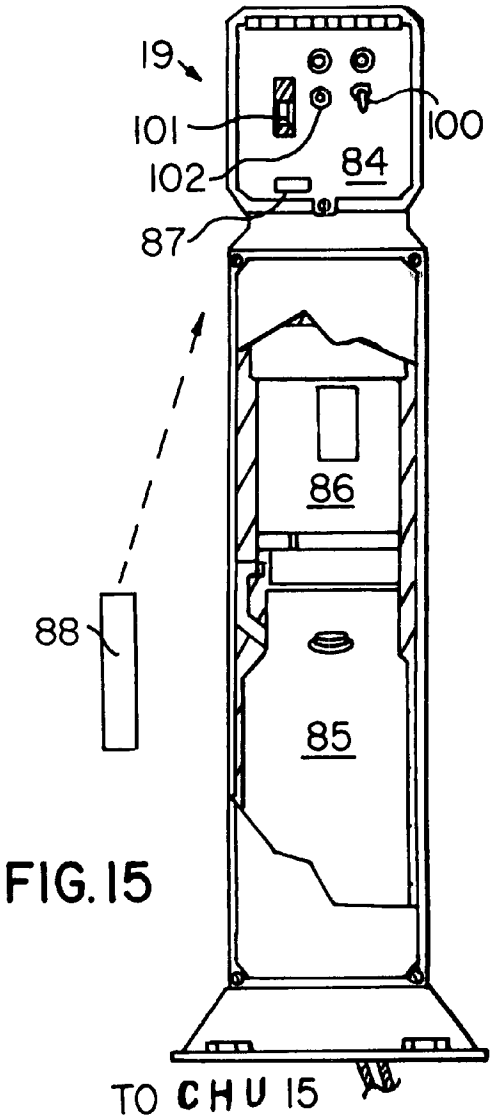
FIG. 15 is an enlarged front elevational view of the fluid reservoir shown in FIG. 11 including remote control apparatus.
Figure 10:
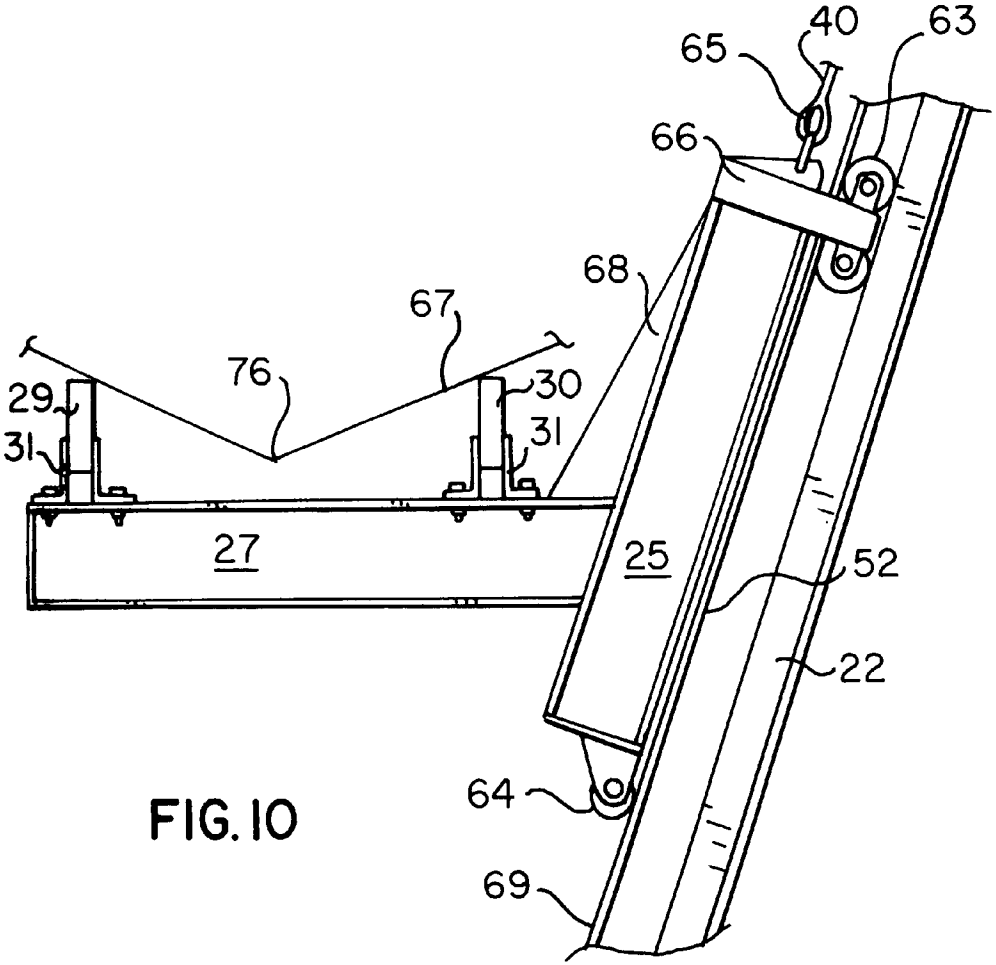
FIG. 10 is an enlarged partial side elevational view showing the cradle secured to a transfer member with rollers positioned along the near and far sides of a piling ledge.

With the power switch, shown generally at 101, at the "on" position and the brake release switch 100 in the "operate" position, moving the "raise/lower" switch 102 to the down direction can lower the vessel, as generally shown in FIG. 11 at reference number 84 (FIG. 15). The raise/lower switch 102 is positioned next to the power switch 100 and is a momentary 3-position switch, which must be held in either position. Such a type of switch is commonly known as a "dead man's" switch.

When installing any boat lift 12 of the present invention, the minimum height of the cable-handling unit 15 may be adjusted to prevent excessive cable slack from being generated. Positioning sensor switches including a first member 94 connected to the movable end 32 of the piston arm 18 and a second member 95 attached to the interior of the cable-handling unit 15 in the travel path of the moving end 32 of the piston arm 18 does this. When the movable end 32 of the piston arm 18 reaches a switch indication can interrupt the power if necessary. The maximum height is equal to the hydraulic piston arm 18 maximum retracted position.

Any embodiment of the present invention may also be fitted with a conventional remote control system 87, 88 (FIG. 15) for operating same. Such a system preferably includes a receiver 87 connected to the electrical control box 84 and a transmitter 88 carried by an operator. The system may be operated by infrared signals, RF signals, or other suitable conventional signals as understood in the art.

A conventional fluid reservoir 19 is attached to a top of a dock 11 with a pair of fluid cables connected to the cable-handling unit 15. The reservoir 19 includes an electronic control box 84 attached to a top end thereof for operating same. Such a control box is pivotable between open and closed positions and includes control switches 100–102 for powering the hydraulic power supply 86 connected to the fluid holding tank 85 of the fluid reservoir 19.

The cable-handling unit 15 of each embodiment of the present invention is preferably manufactured from stainless steel. The components with the cable-handling unit 15 are preferably manufactured of stainless steel or powder-coated aluminum. The hydraulic cylinder body 20 is preferably epoxy-coated steel with the piston arm 18 preferably formed from chromium-plated stainless steel. There are no high-voltage components within the cable-handling unit 15, and therefore, the cable-handling unit 15 is not affected by weather or tidal surge. The cable-handling unit 15 also has an extremely low profile (approximately 7–9 inches) and the cradle 13 bunk rails 27, 28 are preferably manufactured from 6061 T-1 aluminum. All pulleys and brackets are also preferably manufactured from stainless steel and preferably utilize composite material bearings that do no require periodic lubrication and are impervious to salt water. Appropriate covers for the various pulleys may be provided as understood in the art.

In operation, a brake release switch 100, power switch 101, and raise/lower switch 102 all housed on the control box 84 operate the fluid reservoir 19 for extending and retracting the movable end 32 of the piston arm 18. As the moving end 32 of the piston arm 18 is horizontally extended a distance, D, outward from a retracted position, the transfer members 25, 26 move a vertical distance, 3*D, down the pilings 22, 23, respectively. The vertical distance, 3*D, is substantially equal to three times the horizontal distance, D, and such a 3:1 ratio of the vertical movement of transfer members 25, 26 to the horizontal movement of pulley 33 is possible because as same retracts a distance, D, three cable portions 77–79 of each cable 39, 40, defined in FIGS. 2 and 3, must also travel a distance, 0. Therefore, each cable portion 77–79 must travel a distance equal to 3*D. A 2:1 ratio is achievable in the alternate embodiment employing only two pulleys 33, 35 with two cable portions 81, 82, as shown in FIG. 3.

Figure 5:
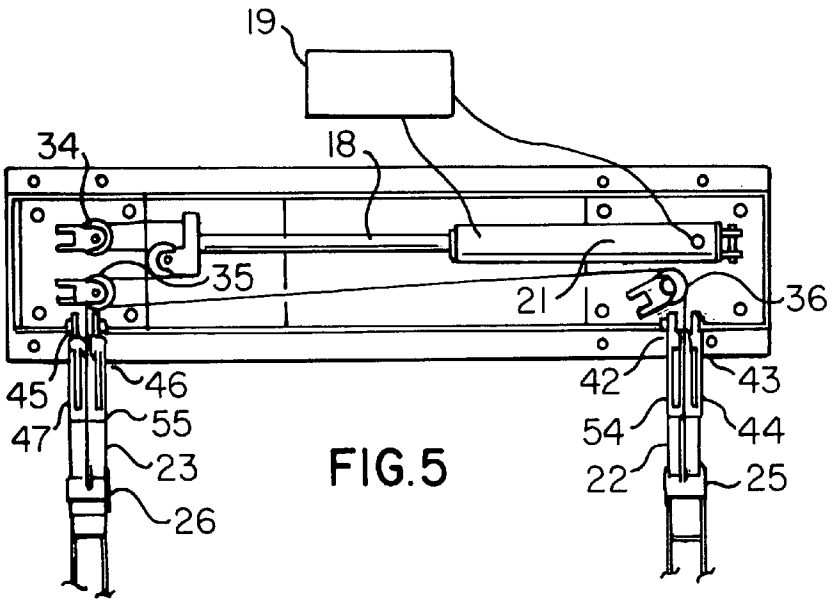
FIG. 5 is a partial top plan view of the boat lift shown in FIG. 1 with the top cover of the cable-handling unit removed therefrom.

The use of the additional pulley 34 in the embodiments of FIGS. 2, 4 and 5 is generally called for in applications where the lengths of cable used with the cable-handling units are critical or where total lifting distances exceed 15 feet.

Configurations employing the additional pulley 34 will gather three times more cable than the physical travel length of the cylinder piston arm such as rod 18. In addition, the counterforce needed to overcome the additional pulley is three times the total weight load of the vessel, this configuration requires larger, more powerful cylinders when compared to the configuration without the use of the additional pulley 34, other factors being equal. Accordingly, the specific configuration employed will be determined by the total lift distance and the total weight to be lifted.

The additional pulley 34 may be used when large tidal differences in water level require longer cable lengths. The preferred configuration would not use the pulley 34 because it would require large and expensive hydraulic systems.

Finally, the vertical elevator approach to the boat lift structure such as in FIG. 1 is ideal in locations where narrow canals would prohibit the use of the two outboard pilings used elsewhere where a larger platform size is needed for the platform lift approaches.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. A boat lift mounted to a dock comprising a cable-handling unit including:

a pair of elongate pilings each having one end mounted into a floor of a body of water and an opposite end extending above an edge of the dock, a movable piston arm and an oppositely disposed stationary cylinder end secured to the dock, a first plurality of pulleys, at least one pulley of said first plurality of pulleys being attached to said piston arm, a second plurality of pulleys cooperating with said first plurality of pulleys;

a cradle for supporting a boat thereon and being operatively movable in a substantially vertical direction along said pair of pilings;

a pair of elongate cables each having one end routed through said at least one pulley attached to said piston arm and extending to and affixed to said cradle and an opposite end secured to said cable handling unit and routed through said first and second pluralities of pulleys, said first plurality of pulleys directing said cables in a substantially horizontal direction and said second plurality of pulleys guiding said cables vertically adjacent said pair of pilings, said piston arm being extensible to a first position away from said cylinder end for lowering said cradle vertically adjacent said pair of pilings and being retractable to a second position for raising said cradle vertically adjacent said pair of pilings, said piston arm and said cylinder end being disposed horizontally to reduce the visual profile of said cable handling unit.

2. The boat lift of claim 1 wherein said cradle includes a pair of guide members for slidably moving said cradle along said pair of pilings.

3. The boat lift as defined in claim 1 further including a third pulley mounted to said cable handling unit supported by the dock spaced away from said first plurality of pulleys, a bracket attached to said piston arm adjacent said at least one pulley of said first plurality of pulleys for affixing said first ends of both of said pair of cables to said bracket, a fourth pulley mounted to said cable handling unit, a first cable of said pair of cables being threaded around a second pulley and a first pulley of said first plurality of pulleys, a second cable of said pair of cables being threaded around said third pulley and also being threaded around said second pulley and said first pulley of said first plurality of pulleys, said first and second cables also being threaded around said fourth pulley such that the vertical distance of movement of said cradle is three times the distance of movement of said piston arm when moving said cradle vertically.

4. The assembly as defined in claim 3 further including first and second guide members mounted between said cradle and first and second pilings of said pair of pilings, respectively, for inhibiting lateral movement of said cradle when said cradle is being moved vertically.

5. The assembly as defined in claim 4 wherein each of said first and second guide members is rigidly mounted to said cradle and slidably engaged with first and second pilings of said pair of pilings, respectively.

6. The assembly as defined in claim 5 wherein each of said first and second guide members include rollers mounted against said first and second pilings of said pair of pilings, respectively.

7. The assembly of claim 4 wherein each of said first ends of said first and second cables of said pair of cables is secured to said first and second guide members, respectively, for raising and lowering said cradle.

8. The assembly of claim 7 wherein said cradle further includes first and second bunk rails each having a first end secured to said first and second guide members, respectively, and each having a second end disposed substantially perpendicularly to said first and second guide members, respectively, said cradle further including first and second elongate bunks secured onto and extending transversely across said first and second bunk rails, respectively, for maintaining a boat therebetween.

9. An assembly for lifting a boat locatable adjacent a dock comprising a pair of elongate pilings having a lower end portion mounted into the floor of a body of water near the dock and an upper end portion extending upwardly adjacent the dock, a cradle for carrying a boat, lifting means connected to said cradle for moving said cradle substantially vertically, said lifting means including a movable member attached to the dock, and cable means mounted to each said piling and being connected between said movable member and said cradle, said movable member being movable between a first position for lifting said cradle and a second position for lowering said cradle, said movable member including a hydraulic operating means having an extensible piston arm and a stationary cylinder, said cable means mounted to said piston arm, said cable means including a first pulley mounted to said piston arm and a second pulley mounted to the dock adjacent said first pulley and a third pulley mounted to the dock at a location spaced away from said second pulley, a first cable having one end attached to said cradle and a second cable having one end attached to said cradle spaced away from said first cable, a bracket for affixing other ends of both said cables to the dock at a single location, said first cable threaded around said second pulley and said first pulley, said second cable threaded around said third pulley and said second pulley and said first pulley such that the vertical distance of movement of said cradle is twice the distance of movement of said piston arm when said hydraulic operating means is operated for moving said cradle vertically.

10. The assembly as defined in claim 9 wherein said lifting means includes at least one pulley on each said piling for mounting said cable means to each said piling.

11. The assembly as defined in claim 9 further including a pair of guide members mounted between said cradle and a respective said piling, one said guide member being slidably engaged with said piling, another said guide member being slidably engaged with another said piling for inhibiting lateral movement of said cradle when said cradle is being moved vertically.

12. The assembly as defined in claim 11 wherein each said guide member is rigidly mounted to said cradle and slidably engaged with a respective said piling.

13. The assembly as defined in claim 12 wherein each said guide member includes rollers mounted against said respective piling.

14. The assembly as defined in claim 12, wherein said cradle further includes a pair of bunk rails each having one end secured to a respective one of said pair of guide members and each having one free end disposed substantially perpendicularly to said respective guide members, said cradle further including a pair of elongate bunks secured onto and extending transversely across said pair of bunk rails for maintaining a boat therebetween.

15. The assembly as defined in claim 14, further including a second pair of pilings oppositely spaced from said first pair of pilings and mounted adjacent said free ends of said pair of bunk rails and onto a floor of a body of water; and a second pair of guide members secured to respective free ends of said pair of bunk rails and movable along said second pair of pilings for providing stability to said cradle as said cradle moves along said pair of pilings.

16. The assembly as defined in claim 9 wherein said pilings are inclined from the vertical direction with said lower end portion of each said piling being located outwardly of the dock and said upper end portion of each said piling being closely adjacent the dock.

* * * * *